US006494018B1

(12) United States Patent
Vanderlee et al.

(10) Patent No.: US 6,494,018 B1
(45) Date of Patent: Dec. 17, 2002

(54) METHOD AND APPARATUS FOR GUIDING A FASTENER IN A BAG MAKING MACHINE

(75) Inventors: David G. Vanderlee, Macedon, NY (US); Aaron L. Strand, Plymouth, WI (US)

(73) Assignee: Pactiv Corporation, Lake Forrest, IL (US)

( * ) Notice: Subject to any disclaimer, the term of this patent is extended or adjusted under 35 U.S.C. 154(b) by 26 days.

(21) Appl. No.: 09/635,451

(22) Filed: Aug. 9, 2000

(51) Int. Cl.[7] ..... B65B 61/18

(52) U.S. Cl. ..... 53/133.4; 493/213; 493/223; 83/54; 83/921

(58) Field of Search ..... 53/412, 133.4, 53/139.2; 156/66; 493/213, 214, 927, 194, 196, 223; 83/54, 921

(56) References Cited

U.S. PATENT DOCUMENTS

| | | | | |
|---|---|---|---|---|
| 3,381,592 A | | 5/1968 | Ravel | |
| 3,473,589 A | | 10/1969 | Gotz | |
| 3,532,571 A | * | 10/1970 | Ausnit | 493/214 |
| RE27,174 E | | 9/1971 | Ausnit | |
| 3,608,439 A | | 9/1971 | Ausnit | |
| 3,613,524 A | | 10/1971 | Behr et al. | |
| 3,701,191 A | | 10/1972 | Laguerrre | |
| 3,701,192 A | | 10/1972 | Laguerre | |
| 3,785,111 A | | 1/1974 | Pike | |
| 3,839,128 A | | 10/1974 | Arai | |
| 3,948,705 A | | 4/1976 | Ausnit | |
| 4,094,729 A | | 6/1978 | Boccia | |
| 4,196,030 A | | 4/1980 | Ausnit | |
| 4,240,241 A | | 12/1980 | Sanborn, Jr. | |
| 4,246,288 A | | 1/1981 | Sanborn, Jr. | |
| 4,277,241 A | | 7/1981 | Schulze | |
| 4,341,575 A | | 7/1982 | Herz | |
| 4,355,494 A | | 10/1982 | Tilman | |

(List continued on next page.)

FOREIGN PATENT DOCUMENTS

| | | |
|---|---|---|
| EP | 0 939 034 | 9/1999 |
| EP | 0 978 450 | 2/2000 |
| EP | 1 026 077 A2 | 8/2000 |
| GB | 2 085 519 | 4/1982 |
| WO | 99/24325 | 5/1999 |

*Primary Examiner*—John Sipos
(74) *Attorney, Agent, or Firm*—Jenkens & Gilchrist

(57) ABSTRACT

A method and apparatus for guiding a fastener in a bag making machine includes a stationary support, an elongated internal guide, and a slitting mechanism. The elongated internal guide is mounted to the support and positioned within an enclosed space defined by the fastener. The fastener is moved downstream with the internal guide within the enclosed space. The fastener is slit upstream from the support. While the fastener is guided, a sealer may seal the fastener to a moving web of plastic film along a seal adjacent to the internal guide.

19 Claims, 3 Drawing Sheets

U.S. PATENT DOCUMENTS 4,372,793 A 2/1983 Herz
4,415,386 A 11/1983 Ferrell et al.
4,430,070 A 2/1984 Ausnit
4,437,293 A 3/1984 Sanborn, Jr.
4,517,788 A 5/1985 Scheffers
4,528,224 A 7/1985 Ausnit
4,563,319 A 1/1986 Ausnit et al.
4,581,006 A 4/1986 Hugues et al.
4,582,549 A 4/1986 Ferrell
4,601,694 A 7/1986 Ausnit
4,617,683 A 10/1986 Christoff
4,651,504 A 3/1987 Bentsen
4,655,862 A 4/1987 Christoff et al.
4,663,915 A 5/1987 Van Erden et al.
4,666,536 A 5/1987 Van Erden et al.
4,673,383 A 6/1987 Bentsen
4,691,372 A 9/1987 Van Erden
4,703,518 A 10/1987 Ausnit
4,709,398 A 11/1987 Ausnit
4,709,533 A 12/1987 Ausnit
4,710,157 A 12/1987 Posey
4,782,951 A 11/1988 Griesbach et al.
4,787,880 A 11/1988 Ausnit
4,790,126 A 12/1988 Boeckmann
4,807,300 A 2/1989 Ausnit et al.
4,812,074 A 3/1989 Ausnit et al.
4,840,012 A 6/1989 Boeckmann
4,840,611 A 6/1989 Van Erden et al.
4,844,759 A 7/1989 Boeckmann
4,850,178 A 7/1989 Ausnit
4,876,842 A 10/1989 Ausnit
4,878,987 A 11/1989 Ven Erden
4,892,414 A 1/1990 Ausnit
4,892,512 A 1/1990 Branson
4,894,975 A 1/1990 Ausnit
4,909,017 A 3/1990 McMahon et al.
4,924,655 A 5/1990 Posey
4,925,318 A 5/1990 Sorensen
4,929,225 A 5/1990 Ausnit et al.
4,941,307 A 7/1990 Wojcik
4,969,309 A 11/1990 Schwarz et al.
4,974,395 A 12/1990 McMahon
4,993,212 A 2/1991 Veoukas
5,005,707 A 4/1991 Hustad et al.
5,014,498 A 5/1991 McMahon
5,027,584 A 7/1991 McMahon et al.
5,036,643 A 8/1991 Bodolay
5,042,224 A 8/1991 McMahon
5,046,300 A 9/1991 Custer et al.
5,063,639 A 11/1991 Boeckmann et al.
5,072,571 A 12/1991 Boeckmann
5,085,031 A 2/1992 McDonald
5,092,831 A 3/1992 James et al.
5,096,516 A 3/1992 McDonald et al.
5,105,603 A 4/1992 Natterer
5,107,658 A 4/1992 Hustad et al.
5,111,643 A 5/1992 Hobock
5,116,301 A 5/1992 Robinson et al.
5,127,208 A 7/1992 Custer et al.
5,147,272 A 9/1992 Richison et al.
5,152,613 A * 10/1992 Herrington, Jr. ..... 156/66
5,179,816 A * 1/1993 Wojnicki
5,188,461 A 2/1993 Sorensen
5,211,482 A 5/1993 Tilman
5,247,781 A 9/1993 Runge
5,254,073 A 10/1993 Richison et al.
5,259,904 A 11/1993 Ausnit
5,273,511 A 12/1993 Boeckmann
5,322,579 A 6/1994 Van Erden
5,334,127 A 8/1994 Bruno et al.
5,383,989 A 1/1995 McMahon
5,400,565 A 3/1995 Terminella et al.
5,400,568 A 3/1995 Kanemitsu et al.
5,405,629 A 4/1995 Marnocha et al.
5,412,924 A 5/1995 Ausnit
5,415,904 A 5/1995 Takubo et al.
5,425,216 A 6/1995 Ausnit
5,425,825 A 6/1995 Rasko et al.
5,435,864 A 7/1995 Machacek et al.
5,470,156 A 11/1995 May
5,489,252 A 2/1996 May
5,492,411 A 2/1996 May
5,505,037 A 4/1996 Terminella et al.
5,509,735 A 4/1996 May
5,511,884 A 4/1996 Bruno et al.
5,519,982 A 5/1996 Herber et al.
5,525,363 A 6/1996 Herber et al.
5,542,902 A 8/1996 Richison et al.
5,551,127 A 9/1996 May
5,551,208 A 9/1996 Van Erden
5,557,907 A 9/1996 Malin et al.
5,558,613 A 9/1996 Tilman et al.
5,561,966 A 10/1996 English
5,564,259 A 10/1996 Stolmeier
5,573,614 A 11/1996 Tilman et al.
5,592,802 A 1/1997 Malin et al.
5,613,934 A 3/1997 May
5,628,566 A 5/1997 Schreiter
5,647,671 A 7/1997 May
5,669,715 A 9/1997 Dobreski et al.
5,682,730 A 11/1997 Dobreski
5,725,312 A 3/1998 May
5,782,733 A 7/1998 Yeager
5,788,378 A 8/1998 Thomas
5,823,933 A 10/1998 Yeager
5,833,791 A 11/1998 Bryniarski et al.
5,906,438 A 5/1999 Laudenberg
5,956,924 A 9/1999 Thieman
6,044,621 A 4/2000 Malin et al.
6,138,436 A 10/2000 Malin et al.
6,138,439 A 10/2000 McMahon et al.

* cited by examiner

METHOD AND APPARATUS FOR GUIDING A FASTENER IN A BAG MAKING MACHINE

REFERENCE TO RELATED APPLICATIONS

The present application is being filed concurrently with U.S. patent application Ser. No. 09/636,244 entitled "Injection-Molded End Stop for a Slider-Operated Fastener," U.S. patent application Ser. No. 09/636,421 entitled "Slider-Operated Fastener With Spaced Notches and Associated Preseals," U.S. patent application Ser. No. 09/637,037 entitled "Method of Applying a Slider to a Fastener-Carrying Plastic Web," and U.S. patent application Ser. No. 09/637,038 entitled "Method and Apparatus for Making Reclosable Plastic Bags Using a Pre-Applied Slider-Operated Fastener," all of which are incorporated herein by reference in their entireties.

FIELD OF THE INVENTION

The present invention generally relates to reclosable plastic bags and, more particularly, to a method and apparatus for guiding a fastener in a bag making machine. As used herein, the term "bag making machine" may refer to a form, fill, and seal machine or a machine that makes empty bags.

BACKGROUND OF THE INVENTION

In one method for making reclosable bags, a continuous fastener is sealed to a moving web of thermoplastic film. The fastener-carrying web is subsequently processed into individual plastic bags. One type of fastener includes a pair of interlocking profiles and a pair of fins/flanges extending from the respective profiles. Sliders are preferably mounted to the fastener at bag-width intervals for engaging and disengaging its profiles in response to movement therealong.

In one technique for installing sliders on the fastener, notches are formed in the fastener at bag-width distances apart. To install a slider on the fastener via a respective notch, the slider is first positioned within the notch, and then the slider is threaded onto an end of the fastener in response to relative movement of the slider and fastener. This installation technique is disclosed in U.S. patent application Ser. No. 09/307,937 (PCOS015) entitled "Zipper and Zipper Arrangements and Methods of Manufacturing the Same", filed May 10, 1999, and incorporated herein by reference in its entirety. To form a notch, a short segment of the interlocked profiles and an upper portion of the fins extending from that segment are cut away from the fastener, leaving only a lower portion of the fins bridging opposite sides of the notch. Due to the notches and the mounted sliders, the fastener can be difficult to guide and control when processed through a bag making machine. The fastener tends to twist and distort. For example, when sealing the fastener to the web of plastic film, any distortion in the fastener could cause an uneven seal between the fastener and the web. The uneven seal, in turn, could cause wrinkles in the web and a package that leaks due to unsealed or weakly sealed areas.

Furthermore, to seal the fastener to the web of plastic film, a sealer generates seals between the fastener's fins and the web. Unless precise operational control is maintained over such variables as the alignment, temperature, pressure, and dwell time of the sealer, the sealer could transfer excessive heat to the fins during the sealing process. Such excessive heat could deform the fins, cause the fins to stick to each other, or even accidentally seal the fins to each other. These fin-related problems are exacerbated if the fins are relatively thin and are composed of compatible materials that readily bond to each other. If the fastener is not located properly to the web, the sealer may miss the fastener or seal a skewed fastener to the web resulting in a nonfunctional fastener in the final package.

SUMMARY OF THE INVENTION

To overcome the aforementioned shortcomings, the present invention provides a method and apparatus for guiding a fastener in a bag making machine. The apparatus includes a stationary support, an elongated internal guide, and an slitting mechanism. The elongated internal guide is mounted to the support and positioned within an enclosed space defined by the fastener. The fastener is moved downstream with the internal guide within the enclosed space. The fastener is slit upstream from the support. While the fastener is guided, a sealer may seal the fastener to a moving web of plastic film along a seal adjacent to the internal guide.

As the name suggests, the internal guide helps to guide and control the fastener so that it does not twist or distort while moving downstream through the bag making machine. In addition, the internal guide serves as an effective insulator between fastener portions on opposite sides of the internal guide. While the sealer seals the fastener to the moving web, the sealer will not deform such fastener portions, cause the fastener portions to stick to each other, or accidentally seal the fastener portions to each other. In fact, the internal guide reduces the degree of operational control that must be maintained over such variables as the temperature, pressure, and dwell time of the sealer.

BRIEF DESCRIPTION OF THE DRAWINGS

Other objects and advantages of the invention will become apparent upon reading the following detailed description and upon reference to the drawings in which.

Figure 1:
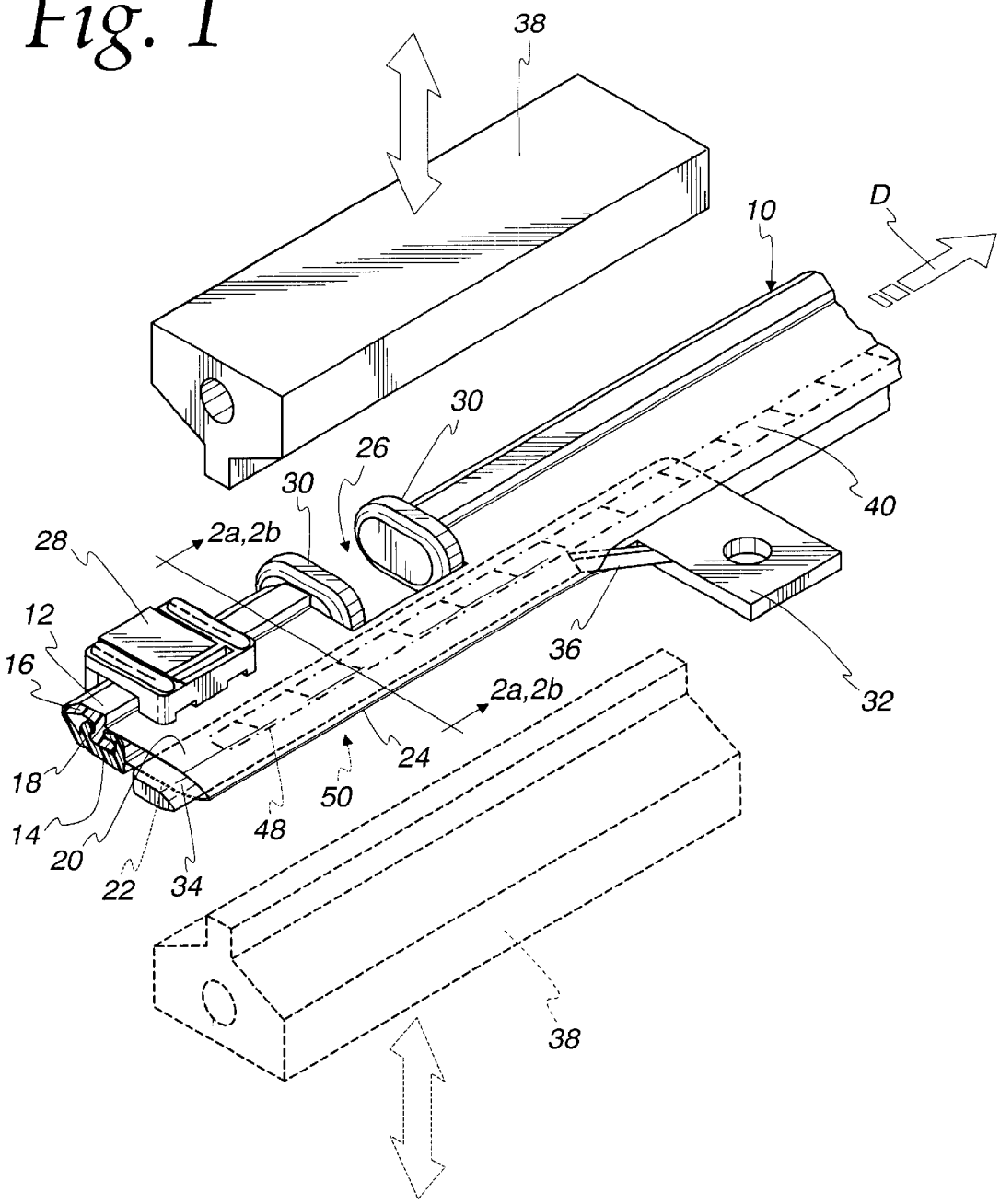
FIG. 1 is an isometric view of a method and apparatus for guiding and sealing a fastener in a bag making machine where the fastener is sealed to a web of plastic film shown in FIGS. 2*a* and 2*b;*

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DESCRIPTION OF ILLUSTRATIVE EMBODIMENTS

Turning to the drawings, FIG. 1 depicts a method and apparatus for guiding and sealing a fastener 10 in a bag making machine. The fastener 10 includes first and second opposing tracks 12 and 14. The first and second tracks 12 and 14 include respective first and second interlocking profiles 16 and 18 and respective first and second fins 20 and 22 extending from the respective first and second profiles 16 and 18. The fins 20 and 22 are initially joined to each other along a breakable juncture 24 to form an enclosed space. The enclosed space is bounded by the interlocking profiles, the breakable juncture, and the fins. The juncture 24 may be rendered breakable by virtue of a perforated line, scored line, thinned die line, plastic oriented to propagate a tear along the juncture, or plastic material that can be cut with a blade. Prior to reaching the apparatus in FIG. 1, the fastener 10 may already include notches 26, sliders 28, and pairs 30 of end stops spaced at approximately bag-width distances apart.

The stationary L-shaped apparatus includes a support 32, an elongated internal guide 34, and an slitting mechanism 36. In operation, the slitting mechanism 36 allows the internal guide 34 to be supported by the support 32 and prevents the fastener 10 from interfering with the support 32 while the fastener 10 is moved downstream through the bag making machine. The slitting mechanism 36 is preferably in the form of a razor-type cutting blade composed of metal or rigid plastic. The blade 36 is connected to an upstream end of the support 32 and extends between the internal guide 34 and the support 32. Alternatively, the blade 36 is connected only to the internal guide 34 or the bag making machine such that it is arranged to slit the fastener 10 upstream from support 32. In the embodiment illustrated in FIG. 1, the blade 36 is arranged to slit the fins 20 and 22 apart along the juncture 24. Alternatively, the slitting mechanism 36 may be wedge shaped to apply enough stress to breakable juncture 24 to fracture at the juncture.

The support 32 is composed of metal or rigid plastic and projects from the internal guide 34 to an exterior of the fastener 10 via the slit juncture 24 so that it can be secured to a fixed portion of the bag making machine. Although the support 32 is illustrated as being connected to a downstream end of the internal guide 34, the support 32 may alternatively be connected anywhere else along the length of the internal guide 34 including, for example, its center or upstream end. The elongated internal guide 34 is fixedly mounted to the support 32, composed of metal or rigid plastic, and positioned within the enclosed space defined by the fastener 10.

Figure 2A:
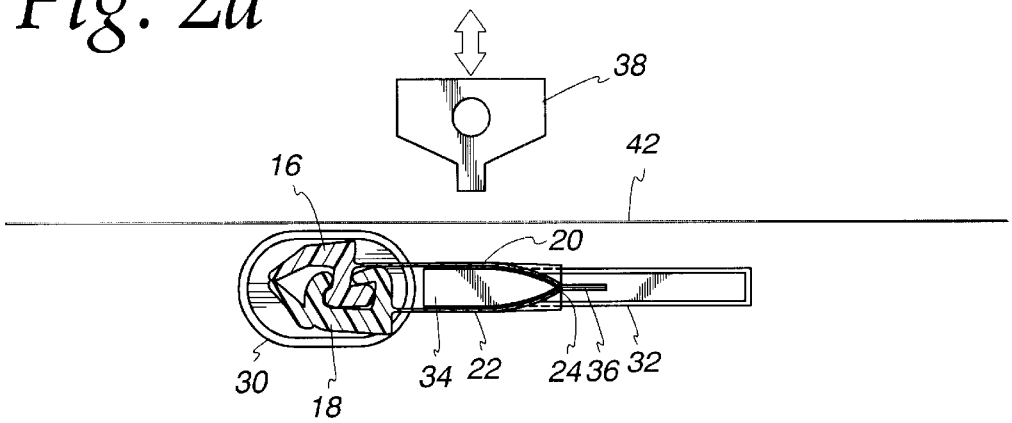
FIG. 2*a* is a section view taken generally along line 2—2 in FIG. 1 showing the fastener being sealed to a flat web of plastic film.
Figure 2B:
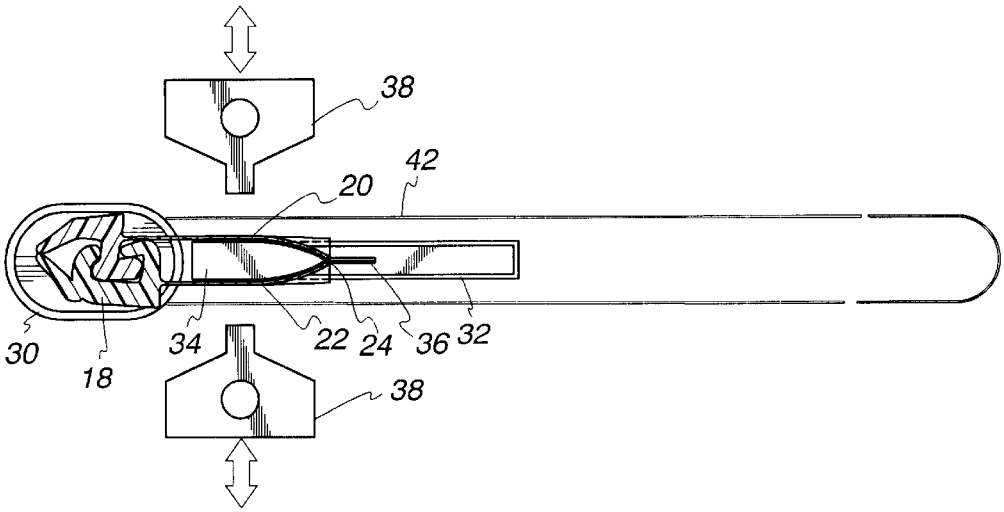
FIG. 2*b* is a section view taken generally along line 2—2 in FIG. 1 showing the fastener being sealed to a folded web of plastic film.

The fastener 10 is conveyed downstream in a direction D with the internal guide 34 within the enclosed space. In the embodiment illustrated in FIG. 1, the blade 36 slits the fastener fins 20 and 22 apart along the juncture 24 immediately upstream from the support 32. While the fastener 10 is guided, a sealer 38 may seal the fastener 10 to a moving web of plastic film along one or more longitudinal seals 40 spaced from the juncture 24. The seal(s) 40 are adjacent to the internal guide 34. As shown in FIGS. 2*a* and 2*b*, the moving web 42 may be flat or C-folded. The web 42 is not shown in FIG. 1 for the sake of clarity.

If the web 42 is flat (FIG. 2*a*), the sealer 38 preferably includes a single heated, reciprocating seal bar that directly contacts the web 42 adjacent the fin 20 while movement of the fastener 10 and the web 42 is temporarily stopped. The temperature, pressure, and dwell time of the seal bar are properly adjusted to allow the seal bar to generate a permanent longitudinal fin seal 40 (see FIG. 1) between the fin 20 and the web 42. Other continuous sealing devices known in the bag manufacturing art can be used to seal fin 20 to web 42. Because the flat web 42 in FIG. 2*a* is only sealed to the fin 20, the web 42 is folded and sealed to the other fin 22 later in the bag manufacturing process.

If the web 42 is C-folded (FIG. 2*b*), the sealer 38 preferably includes a pair of heated, reciprocating seal bars that directly contact the web 42 adjacent the fins 20 and 22 while movement of the fastener 10 and the web 42 is temporarily stopped. The temperature, pressure, and dwell time of the seal bars are properly adjusted to allow the seal bars to permanently seal the fins 20 and 22 to the folded web 42 along respective longitudinal fin seals 40 (see FIG. 1). Other continuous sealing devices known in the bag manufacturing art can be used to seal the fins 20 and 22 to the web 42.

After attaching the fastener 10 to the web 42, the fastener-carrying web 42 is conveyed through other sections of the bag making machine which process the web 42 into individual plastic bags. The plastic bags may be filled with a product and thereafter sealed.

The embodiment illustrated in FIGS. 1 and 2*a–b* is suitable for applications in which the ultimately formed bags do not require a tamper-evident feature of the type disclosed in U.S. Pat. No. 5,964,532 to St. Phillips et al., which is incorporated herein by reference in its entirety. The '532 patent teaches a reclosable plastic package in which the fins (e.g., fins 20 and 22 described above) are joined to each other along a one-time breakable preferential line of weakness (e.g., breakable juncture 24 described above) to prevent tampering with the package prior to being opened. If the line of weakness is intact, the consumer can be reasonably assured that his or her newly purchased package has never been opened before. Because the fins 20 and 22 are split apart along the breakable juncture 24 before the ultimately formed bags reach the consumer, the embodiment in FIGS. 1 and 2*a–b* is not suitable for applications requiring the tamper-evident feature disclosed in the '532 patent.

Figure 3:
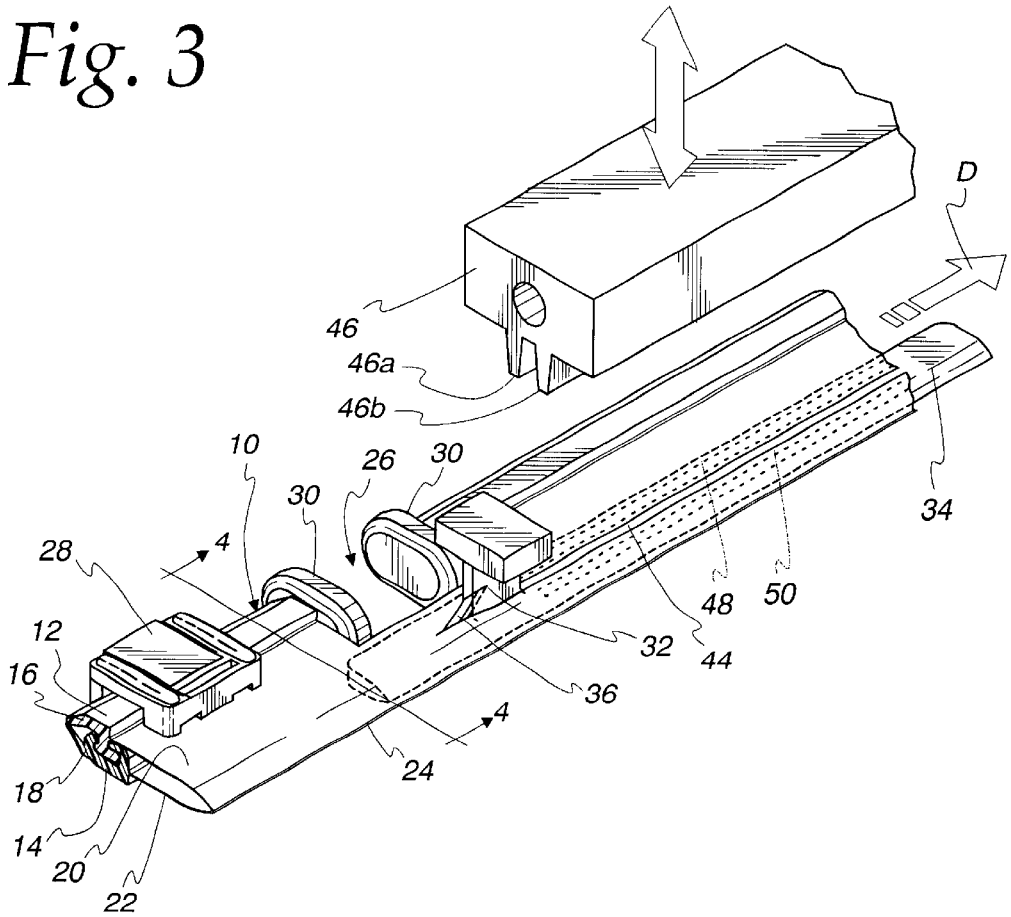
FIG. 3 is an isometric view of a modified method and apparatus for guiding and sealing a fastener in a bag making machine where the fastener is sealed to a web of plastic film shown in FIG. 4.
Figure 4:
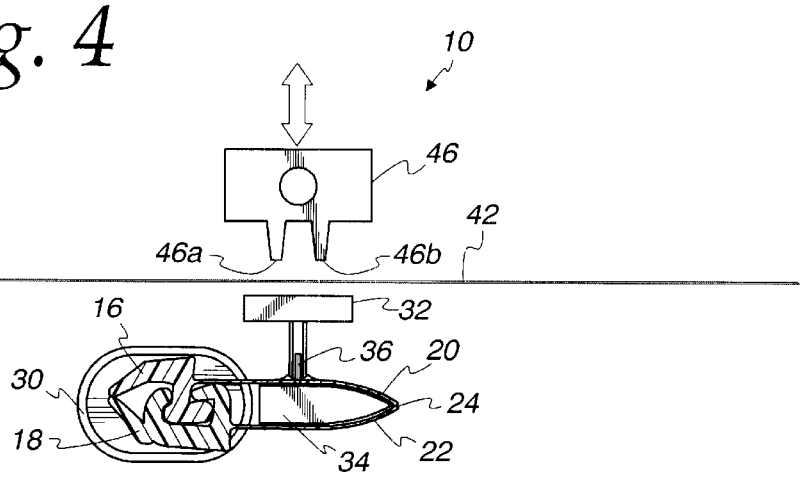
FIG. 4 is a section view taken generally along line 4—4 in FIG. 3 showing the fastener being sealed to a flat web of plastic film.

On the other hand, the embodiment illustrated in FIGS. 3 and 4 is suitable for applications requiring such a tamper-evident feature. FIG. 3 depicts a modified method and apparatus for guiding and sealing the fastener 10 in a bag making machine. Analogous parts are identified by the same reference numerals used above in connection with FIGS. 1 and 2*a–b*. While the support 32 in FIGS. 1 and 2*a–b* projects through the slit juncture 24, the T-shaped support 32 in FIG. 3 projects through a longitudinal slit 44 in the fin 20. The longitudinal slit 44 is spaced from the breakable juncture 24 and is generated by the blade 36, which is connected to an upstream end of the support 32 and extends between the internal guide 34 and the support 32. The support 32 is illustrated in FIG. 3 as being centrally located along the length of the internal guide 34, but may alternatively be located near or at one of the ends of the internal guide 34.

The fastener 10 is conveyed downstream in a direction D with the internal guide 34 within the enclosed space defined by the fastener 10. In the embodiment illustrated in FIG. 3, the blade 36 slits the fastener fin 20 along the longitudinal slit 44 spaced from the juncture 24 immediately upstream from the support 32. While the fastener 10 is guided, a sealer 46 may seal the fastener 10 to a moving flat web 42 (see FIG. 4) of plastic film along first and second longitudinal seals 48 and 50 on opposite sides of the longitudinal slit 44. The web 42 is not shown in FIG. 3 for the sake of clarity. The seals 48 and 50 are adjacent to the internal guide 34. Following the generation of the seals 48 and 50, the fins 20 and 22 are intact and still joined to each along the breakable juncture 24. Therefore, the fastener in FIG. 3 can easily be used to manufacture plastic bags that use the condition of the breakable juncture 24 for tamper evidence.

The sealer 46 preferably includes a heated, reciprocating seal bar that directly contacts the web 42 adjacent the fin 20 while movement of the fastener 10 and the web 42 is temporarily stopped. The seal bar includes a pair of projecting elements 46*a* and 46*b* for generating the respective seals 48 and 50 between the fin 20 and the web 42. The temperature, pressure, and dwell time of the seal bar are properly adjusted to allow the seal bar to generate these seals. Other continuous sealing devices known in the bag manufacturing art can be used to seal fin 20 to web 42. Because the flat web 42 is only sealed to the fin 20, the web 42 is folded and sealed to the other fin 22 later in the bag manufacturing process. In an alternative embodiment, the apparatus of FIG. 3 may be modified to include a second seal bar and then used to attach the fastener 10 to a folded web 42 like in FIG. 2*b*.

After attaching the fastener 10 in FIGS. 3 and 4 to the web 42, the fastener-carrying web 42 is conveyed through other sections of the bag making machine which process the web 42 into individual plastic bags. The plastic bags may be filled with a product and thereafter sealed.

The embodiments illustrated in FIGS. 1–4 are particularly suitable for applications in which the notches 26, sliders 28, and pairs 30 of end stops are applied to the fastener 10 prior to sealing the fastener 10 to the web 42. Due to the notches, sliders, and end stops, the support 32 in these embodiments can only connect to the internal guide 34 via a slit generated by the slitting mechanism 36.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A method of guiding a moving fastener in a bag making machine, comprising:

providing a fastener including first and second opposing tracks, said first and second tracks including respective first and second interlocking profiles and respective first and second fins extending from said respective first and second profiles, said first and second fins initially being joined, said fastener, by itself, defining an enclosed space;

providing a stationary support and an elongated internal guide mounted to said support, said elongated internal guide having a longest dimension extending in a direction of movement of said fastener;

positioning said internal guide within said enclosed space;

moving said fastener downstream with said internal guide within said enclosed space; and slitting said fastener upstream from said support and at a location on said fastener outside of said interlocking profiles.

2. The method of claim 1, wherein said slitting step is accomplished with a blade mounted to said support.

3. The method of claim 1, wherein said first and second fins initially being joined to each other along a breakable juncture to form said enclosed space.

4. The method of claim 3, wherein said slitting step includes slitting one of said fins along a longitudinal slit spaced from said juncture.

5. The method of claim 4, further including sealing said first fin to a moving web of plastic film along first and second longitudinal seals on opposite sides of said longitudinal slit, said seals being adjacent to said internal guide.

6. The method of claim 3, wherein said slitting step includes slitting said fins apart along said juncture.

7. The method of claim 6, further including sealing said first and second fins to a moving web of plastic film along respective first and second longitudinal seals spaced from said juncture, said seals being adjacent to said internal guide.

8. The method of claim 1, further including sealing said fastener to a moving web of plastic film along a seal adjacent to said internal guide.

9. The method of claim 8, wherein said sealing step is accomplished with a heated seal bar that contacts said web.

10. The method of claim 3, further including sealing at least one of said fins to a moving web of plastic film along a seal adjacent to said internal guide.

11. A method of guiding a fastener in a bag making machine, comprising:

providing a fastener including first and second opposing tracks, said first and second tracks including respective first and second interlocking profiles and respective first and second fins extending from said respective first and second profiles, said first and second fins initially being joined to each other along a breakable juncture to form an enclosed space;

providing a stationary support and an elongated internal guide mounted to said support;

positioning said internal guide within said enclosed space;

moving said fastener downstream with said internal guide within said enclosed space; and slitting said fastener along said breakable juncture upstream from said support.

12. The method of claim 11, further including sealing said first and second fins to a moving web of plastic film along respective first and second longitudinal seals spaced from said juncture, said seals being adjacent to said internal guide.

13. The method of claim 11, wherein said slitting step is accomplished with a blade mounted to said support.

14. A method of guiding a moving fastener in a bag making machine, comprising:

providing a fastener including first and second interlocking profiles in a interlocked position and a fin structure connected between said first and second profiles, said fin structure and said first and second interlocking profiles defining an enclosed space;

guiding a movement of said fastener with an elongated internal guide extending substantially in a direction of said movement of said fastener and being mounted to a stationary support, said elongated internal guide being located within said enclosed space and said stationary support being at least partially outside of said enclosed space; and slitting said fin structure of said fastener at a location between said stationary support and an upstream end of said elongated internal guide to provide an opening to said enclosed space through which said stationary support extends.

15. The method of claim 14, wherein said slitting step is accomplished with a blade.

16. The method of claim 15, wherein said blade is mounted to said support.

17. The method of claim 14, further including sealing said fin structure of said fastener to a moving web of plastic film along a seal adjacent to said internal guide.

18. The method of claim 17, wherein said sealing step is accomplished with a heated seal bar that contacts said web.

19. The method of claim 18, wherein said fin structure and said web are sandwiched between said heated scaling bar and said elongated internal guide during said step of sealing.

* * * * *

UNITED STATES PATENT AND TRADEMARK OFFICE

CERTIFICATE OF CORRECTION

PATENT NO. : 6,494,018 B1
DATED : December 17, 2002
INVENTOR(S) : Vanderlee et al.

It is certified that error appears in the above-identified patent and that said Letters Patent is hereby corrected as shown below:

Title page,
Item [73], Assignee, delete "Forrest" and insert -- Forest --
Item [22], Filed: delete "9" and insert -- 10 --

Signed and Sealed this

Third Day of June, 2003

JAMES E. ROGAN
*Director of the United States Patent and Trademark Office*